US007550048B2

(12) United States Patent
Walworth et al.

(10) Patent No.: US 7,550,048 B2
(45) Date of Patent: Jun. 23, 2009

(54) METHOD OF MANUFACTURE USING HEAT FORMING

(75) Inventors: Van T. Walworth, Lebanon, TN (US); Joseph C. Bacarella, LaSalle, MI (US); David B. Hook, Franklin, TN (US); William McGinn, Paragould, AR (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 0 days.

(21) Appl. No.: 11/955,835

(22) Filed: Dec. 13, 2007

(65) Prior Publication Data

US 2008/0148800 A1 Jun. 26, 2008

Related U.S. Application Data

(60) Provisional application No. 60/875,186, filed on Dec. 15, 2006.

(51) Int. Cl.
*C23C 8/00* (2006.01)
*C23C 16/32* (2006.01)
*C23C 16/36* (2006.01)

(52) U.S. Cl. ..... 148/206; 148/219; 75/392

(58) Field of Classification Search ..... 75/392; 148/206, 219

See application file for complete search history.

(56) References Cited

U.S. PATENT DOCUMENTS

| | | | | |
|---|---|---|---|---|
| 3,753,758 | A * | 8/1973 | Shanley | 427/201 |
| 4,497,788 | A * | 2/1985 | Bradley et al. | 423/447.3 |
| 6,117,249 | A * | 9/2000 | Erikson et al. | 148/226 |
| 2003/0056621 | A1 * | 3/2003 | Nakamura et al. | 75/255 |
| 2008/0000550 | A1 * | 1/2008 | Holly et al. | 148/217 |

* cited by examiner

*Primary Examiner*—Timothy C Vanoy
*Assistant Examiner*—Daniel Berns
(74) *Attorney, Agent, or Firm*—Harness, Dickey & Pierce, PLC

(57) ABSTRACT

A method of forming metal parts or components from strip stock or roll stock without yielding is accomplished by first placing the part/components into fixtures that hold the stock in a non-yielding position therein. The fixture and metal stock parts are placed in a liquid, gas, or pack carburizing heat treatment process. Once the carburization process is complete, the part is released from the fixture with little or no spring back, maintaining the shape it was held in while in the fixture, resisting returning to its original shape, and optionally imparting spring-like qualities not associated with the stock before treatment.

10 Claims, 2 Drawing Sheets

METHOD OF MANUFACTURE USING HEAT FORMING

CROSS-REFERENCE TO RELATED APPLICATIONS

Figure 1:
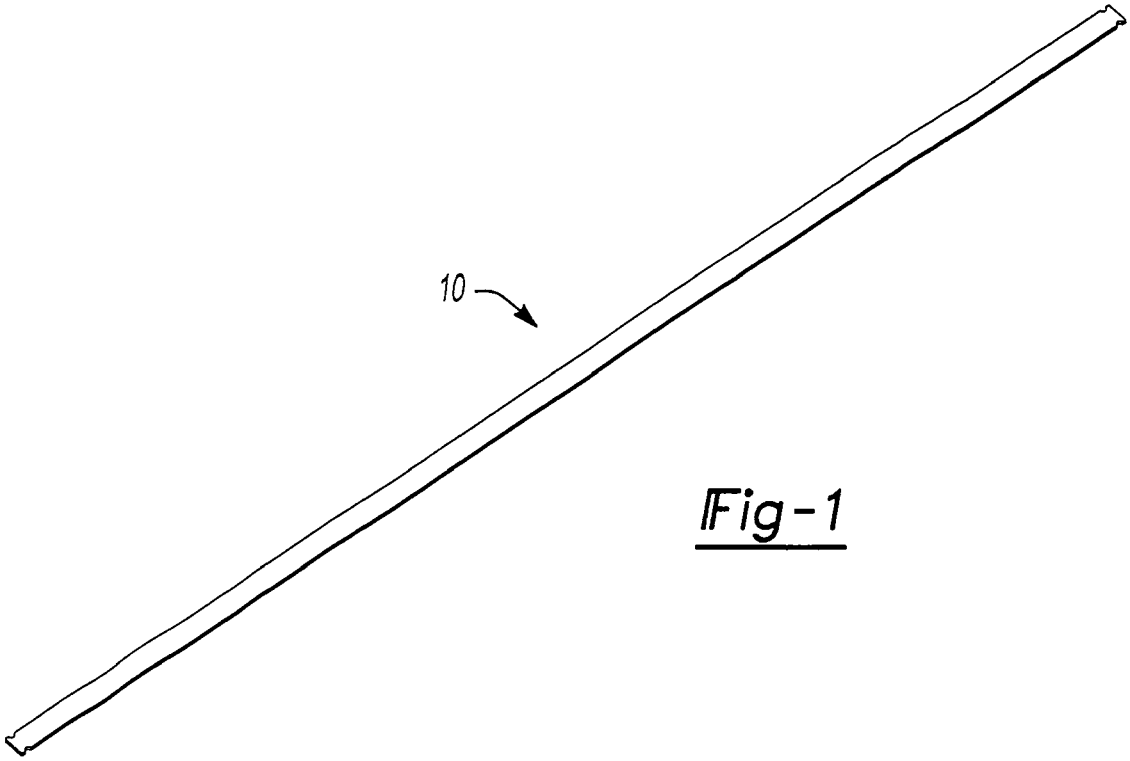

This application claims the benefit of U.S. Provisional Application No. 60/875,186, filed on Dec. 15, 2006. The disclosure of the above application is incorporated herein by reference.

FIELD

The present disclosure relates to metal forming. More particularly, the present invention relates to heat forming metal to achieve desired shapes and properties.

BACKGROUND

The statements in this section merely provide background information related to the present disclosure and may not constitute prior art.

The metal heat treatment industry has many heat treatment methods and processes available for many specific purposes related to various metal products. Heat treatment methods include processes to case harden, strengthen, temper, provide corrosion resistance, stress relieve, coat, etch, as well as many others.

Metal products are commonly fully machined prior to introduction to the heat treatment process. The various heat treatment processes harden the metal and/or stress relieve it, and/or coat it, and/or provide a secondary function of surface treatment or corrosion resistance.

Other metal products are formed prior to heat treatment by one or more manufacturing processes such as stamping, bending, rolling, forging, drawing, winding, etcetera. Subsequent heat treatment provides any one or a combination of the benefits of heat treatment mentioned previously.

Each of these metal-forming processes requires the metal to be yielded in order to shape it. This is true of machining processes that must yield the metal away as it is cut. It is also true of forming processes that must cause the metal to yield into a new shape as it is bent, such as a wound spring or a stamping or bent mounting bracket.

One specialized forming process uses heat treatment to yield and subsequently form the metal product. A windshield wiper beam is the subject of U.S. Pat. No. 6,622,540 which discloses a process of exposing one side of a wiper beam to a heat source while maintaining a cooler temperature on the opposite side of the beam. This process causes the heated surface of the beam to thermally expand greater than the opposing unheated surface of the beam. As a result, the beam is thermally curved.

Excluding the '540 patent, all methods mentioned above require the use of some hard tooling to form yield metal products prior to heat treatment. The tooling is expensive to build and maintain and requires the cost and time of a manufacturing step or sequence of manufacturing steps to yield and form the metal product.

The '540 patent overcomes the disadvantages of traditional forming processes by eliminating the need for hard tooling and the manufacturing step(s) normally associated therewith. However, the '540 patent adds the disadvantage of a specialized heat source process that is difficult to thermally control, and thus difficult to manufacture precise repeatable arc forms. Heat travels through materials at different rates based on the thermal diffusivity of the material. The '540 patent applies heat to one side of a thin metal backbone of a beam wiper and begins to thermally expand that side while maintaining a significantly lower thermal expansion on the opposite side of the thin metal beam. Thermal diffusivity of a thin metal beam is high, resulting in a rapid transfer of heat conduction through the thin metal beam. Therefore, a significant delta-T and a corresponding significant difference of thermal expansion will be unlikely, not to mention difficult and impractical to control.

SUMMARY

It is, therefore, an object of the present invention to provide a method of using standard grade steel stock cut from rolls or strips to form arcs, curves and other shapes without yielding the metal in the process.

It is another object of the present invention to provide a method utilizing fixtures out of non-hardened tooling that creates a pattern, which the steel stock is placed into prior to heat treatment.

Another object of the present invention is to provide a method of forming metal wherein the shape of the stock being held in the fixture does not place yielding stresses on itself.

A further object of the present invention is to subject a metal held in a fixture in a non-yielded state to one of several carburizing heat treatment methods such as liquid carbonizing, pack carburizing, or gas carburizing.

A further object of the present invention is that said carburizing processes impart chemical and/or grain structure change to the metal product held in the fixture, causing the metal to take a set in the fixture position and orientation.

It is an object of the subject method that the metal product will maintain the shape of the fixture after it is removed therefrom.

Another object of the present invention is to provide a carbon steel product with corrosion resistance via the carburizing heat treatment.

Another object of the present invention is to provide a carbon steel product that is stress relieved via the carburizing heat treatment.

Lastly, an object of the present invention is to provide a carbon steel product with spring-like qualities via the carburizing heat treatment even if the steel stock was not necessarily spring steel stock.

These and other objectives are achieved by providing metal parts cut from strip stock or roll stock and placed into fixtures that hold the stock in a non-yielding position therein. The fixture and metal stock parts are placed in a carburizing heat treatment process. Liquid, gas, or pack processes most often accomplish the carburization.

Liquid carburization is accomplished using a salt bath ferritic nitro carburizing treatment followed by a post salt bath oxidative treatment. Gas carburizing is accomplished using one of several carbonaceous gases, such as methane, ethane, propane, or natural gas, followed by an oil quench in a controlled atmosphere. Pack carburizing is accomplished by packing and surrounding the part and the fixture in a steel box full of charcoal granules treated with Barium Carbonate, promoting the formation of $CO_2$ diffusion, followed by a quenching process.

The merits of one carburizing process over another depend on the type of product and/or the number of parts required for throughput. Some heat treatment processes are batch processes, which entails one batch of parts completing a heat treatment cycle before the next batch can be processed. Other heat treatment processes are continuous processes in which each batch follows successively on a walking beam or conveyor system. The availability of one process or the other and/or specific process controls will dictate best fit for a given metal part using carburization heat forming. Though this disclosure describes the improved forming process of windshield wiper beams, the method can be applied to numerous metal products while still remaining within the scope of the present invention.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 2A:
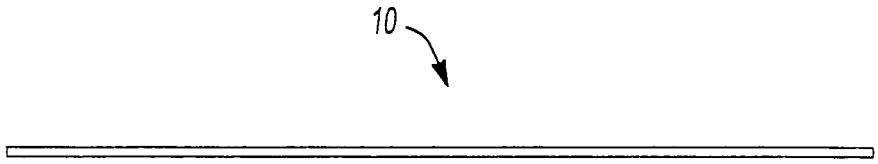
Figure 2B:
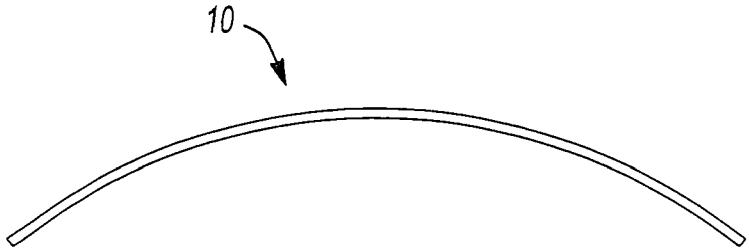
Figure 2C:
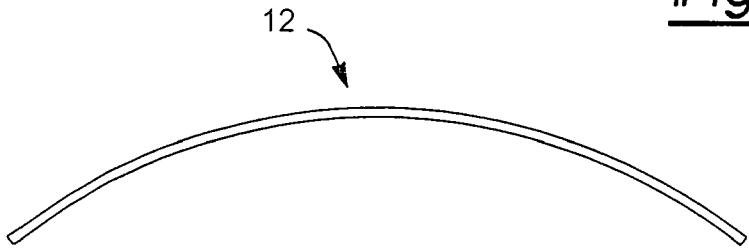
Figure 3A:
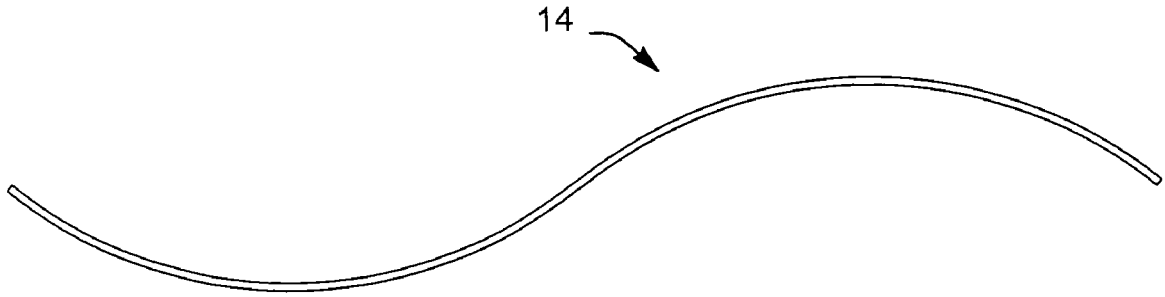
Figure 3B:
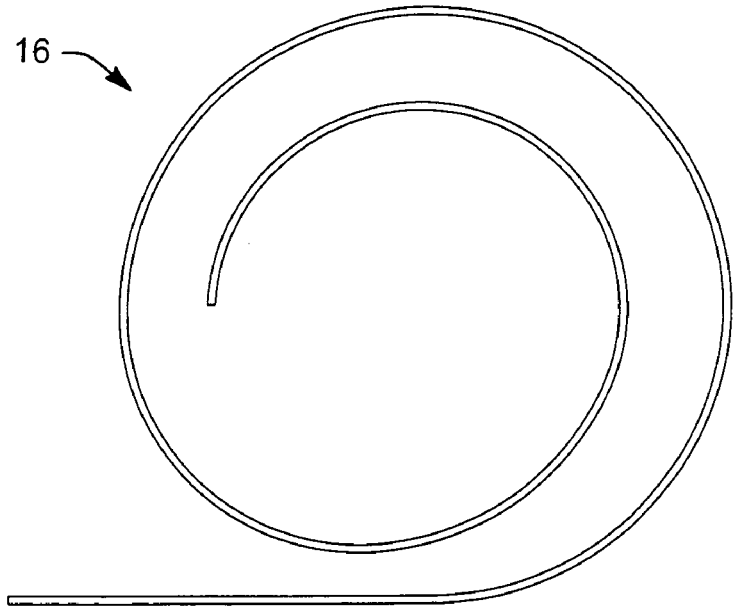

FIG. 1 is a perspective view of a piece of linear stock metal prior to the carburization process;

FIG. 2*a* is a side view of a piece of linear stock metal prior to the carburization process;

FIG. 2*b* is a side view of a piece of stock metal during the carburization process;

FIG. 2*c* is a side view of a piece of stock metal after the carburization process, showing the formed shape;

FIG. 3*a* is a side view of a metal product shown after the carburization process, illustrating one type of achievable shape; and FIG. 3*b* is a side view of another metal product shown after the carburization process, illustrating a further type of achievable shape.

DETAILED DESCRIPTION

The following description is merely exemplary in nature and is not intended to limit the present disclosure, application, or uses.

With reference to the figures, metal parts having a normally flat, linear disposition, and shown generally as 10, are cut from strip stock or roll stock and placed into fixtures that hold the stock in a non-yielding stressed position therein as shown in FIG. 2*a*. The fixture and metal stock parts are placed in a carburizing heat treatment process, generally liquid, gas, or pack processes, to accomplish the carburization.

Liquid carburization is accomplished using a salt bath ferritic nitro carburizing treatment followed by a post salt bath oxidative treatment. Gas carburizing is accomplished using one of several carbonaceous gases, such as methane, ethane, propane, or natural gas, followed by an oil quench in a controlled atmosphere. Pack carburizing is accomplished by packing and surrounding the part and the fixture in a steel box full of charcoal granules treated with Barium Carbonate, promoting the formation of $CO_2$ diffusion followed by a quenching process. Once the carburization process is complete, the part 10 is released from the fixture with little or no spring back, maintaining the shape it was held in while in the fixture, and fails to return to its original flat shape as shown in FIG. 2*c* which illustrates a finished part 12.

The processes can be utilized to create complex shapes of finished parts 14 and 16 with linear stock above and beyond simple curves as shown in FIGS. 3*a* and 3*b*. Furthermore, the processes can impart spring-like characteristics to the metal once the carburization process is complete.

The merits of one carburizing process over another depend on the type of product and/or the number of parts required for throughput. Some heat treatment processes are batch processes in which one batch of parts completes a heat treatment cycle before the next batch can be processed. Other heat treatment processes are continuous processes that allow each batch to follow successively on a walking beam or conveyor system. The availability of one process or the other and/or specific process controls will dictate best fit for a given metal part using carburization heat forming.

Further areas of applicability will become apparent from the description provided herein. It should be understood that the description and specific examples are intended for purposes of illustration only and are not intended to limit the scope of the present disclosure.

What is claimed is:

1. A method of forming a metal component from strip metal stock, comprising:

providing the strip metal stock having a first shape;

placing the strip metal stock into a fixture;

holding the strip metal stock in the fixture in a non-yielding position defining a second shape different than the first shape;

placing the fixture and the strip metal stock having the second shape into a liquid carburization treatment, said treatment comprising a first salt bath subjecting said strip metal stock having the second shape to a ferritic nitro carburizing treatment;

removing the fixture and the strip metal stock having the second shape from said first salt bath and placing the fixture and the strip metal stock having the second shape in a post salt bath and oxidative treatment; and separating the strip metal stock having the second shape from the fixture, wherein the strip metal stock retains the second shape after being separated from the fixture to form the metal component.

2. A method of forming a metal component from strip metal stock, comprising:

providing the strip metal stock having a first shape;

placing the strip metal stock into a fixture;

holding the strip metal stock in the fixture in a non-yielding position;

placing the fixture and the strip metal stock having the second shape into a gas carburizing treatment, wherein said strip metal stock having the second shape is subject to treatment by a gas;

removing the fixture and the strip metal stock having the second shape from said gas treatment and oil quenching said fixture and the strip metal stock having the second shape in a controlled atmosphere; and separating the strip metal stock having the second shape from the fixture, wherein the strip metal stock retains the second shape after being separated from the fixture to form the metal component.

3. The method of forming a metal component from strip metal stock of claim 2, wherein the gas utilized is methane.

4. The method of forming a metal component from strip metal stock of claim 2, wherein the gas utilized is ethane.

5. The method of forming a metal component from strip metal stock of claim 2, wherein the gas utilized is propane.

6. The method of forming a metal component from strip metal stock of claim 2, wherein the gas utilized is natural gas.

7. A method of forming a metal component from strip metal stock, comprising:

providing the strip metal stock having a first shape;

placing the strip metal stock into a fixture;

holding the strip metal stock in the fixture in a non-yielding position defining a second shape different than the first shape;

placing the fixture and the strip metal stock having the second shape into a pack carburization treatment, said treatment comprising surrounding the strip metal component having the second shape and the fixture in a box containing charcoal granules treated with Barium Carbonate;

removing the fixture and strip metal stock having the second shape from said box and subjecting the fixture and the strip metal stock having the second shape to a quenching process;

separating the strip metal stock having the second shape from the fixture, wherein the strip metal retains the shape after being separated from the fixture to form the metal component.

8. The method of forming a metal component from strip metal stock of claim 1, wherein the non-yielding position is a non-yielding stressed position.

9. The method of forming a metal component from strip metal stock of claim 2, wherein the non-yielding position is a non-yielding stressed position.

10. The method of forming a metal component from strip metal stock of claim 7, wherein the non-yielding position is a non-yielding stressed position.

* * * * *